US008832893B1

(12) United States Patent
Morris et al.

(10) Patent No.: US 8,832,893 B1
(45) Date of Patent: Sep. 16, 2014

(54) OPERABLE RAMP

(71) Applicants: Donald Morris, Littleton, CO (US); David Johnson, Modesto, CA (US)

(72) Inventors: Donald Morris, Littleton, CO (US); David Johnson, Modesto, CA (US)

(73) Assignee: Lift-U, division of Hogan Mfg., Inc., Escalon, CA (US)

( * ) Notice: Subject to any disclaimer, the term of this patent is extended or adjusted under 35 U.S.C. 154(b) by 0 days.

(21) Appl. No.: 14/152,929

(22) Filed: Jan. 10, 2014

(51) Int. Cl.
*B66B 9/08* (2006.01)

(52) U.S. Cl.
USPC ..... 14/71.3; 414/921; 244/88; 187/200

(58) Field of Classification Search
USPC ..... 14/71.1, 71.3; 254/88; 187/200; 414/921
See application file for complete search history.

(56) References Cited

U.S. PATENT DOCUMENTS

| | | | | |
|---|---|---|---|---|
| 3,902,213 | A * | 9/1975 | Pfleger et al. | 14/71.3 |
| 4,022,337 | A | 5/1977 | Eichenhofer | |
| 4,027,807 | A | 6/1977 | Thorley | |
| 4,081,091 | A | 3/1978 | Thorley | |
| 4,124,096 | A | 11/1978 | Dudynskyj | |
| 4,124,098 | A | 11/1978 | Dudynskyj | |
| 4,124,099 | A | 11/1978 | Dudynskyj | |
| 4,164,292 | A | 8/1979 | Karkau | |
| 4,176,999 | A | 12/1979 | Thorley | |
| 4,180,366 | A | 12/1979 | Roth | |
| 4,251,179 | A | 2/1981 | Thorley | |
| 4,270,630 | A | 6/1981 | Karkau | |
| 4,285,416 | A | 8/1981 | Dudynskyj | |
| 4,559,659 | A | 12/1985 | Hunter, Jr. | |
| 4,583,466 | A | 4/1986 | Reddy | |
| 5,230,288 | A | 7/1993 | Bickel | |
| 5,284,414 | A | 2/1994 | Kempf | |
| 5,316,432 | A | 5/1994 | Smalley | |
| 5,425,615 | A | 6/1995 | Hall | |
| 5,439,342 | A | 8/1995 | Hall | |
| 5,454,196 | A | 10/1995 | Gaines | |
| 5,813,072 | A * | 9/1998 | Alexander | 14/71.1 |
| 5,947,231 | A * | 9/1999 | Raab et al. | 187/200 |
| 6,764,123 | B1 | 7/2004 | Bilyard | |
| 6,931,686 | B2 * | 8/2005 | Hoofard et al. | 14/69.5 |
| 7,062,813 | B2 * | 6/2006 | Hoofard et al. | 14/69.5 |
| 7,162,761 | B2 * | 1/2007 | Alexander et al. | 14/71.3 |
| 7,216,392 | B2 * | 5/2007 | Hoofard et al. | 14/71.1 |
| 7,225,493 | B2 * | 6/2007 | Hoofard et al. | 14/69.5 |
| 8,161,589 | B1 * | 4/2012 | Heffernan et al. | 14/71.3 |

* cited by examiner

*Primary Examiner* — Gary Hartmann
(74) *Attorney, Agent, or Firm* — Christensen O'Connor Johnson Kindness PLLC

(57) ABSTRACT

An operable ramp is moveable between a stowed position and a deployed position. The operable ramp includes a ramp panel rotatable about a first end. A second end of the ramp panel is lower in the deployed position than in the stowed position. A rotatable support supports a second end of the ramp panel, and a drive assembly selectively rotates the support (1) in a first direction to lower the second end of the ramp panel and (2) in a second direction to raise the second end of the ramp panel. A stop limits rotation of the support in the second direction when the operable ramp is in the stowed position. The weight of the ramp panel biases the support in the second direction, i.e., toward the stop, when the operable ramp is in the stowed position.

5 Claims, 9 Drawing Sheets

OPERABLE RAMP

BACKGROUND

The Americans with Disabilities Act (ADA) requires the removal of physical obstacles to those who are physically challenged. The stated objective of this legislation has increased public awareness and concern over the requirements of the physically challenged. Consequentially, there has been more emphasis on providing systems that enable physically challenged people to access buildings and other architectural structures that have a step at the point of ingress or egress.

Installing a fixed ramp is a common way to provide the physically challenged with access to a building with one or more steps at the entrance. Fixed ramps take up a large amount of space and often detract from the aesthetic qualities of the building. Fold out ramps, similar to those used in vehicles can be utilized, but deployment often requires a large area into which the ramp deploys. Accordingly, there is a need for a ramp that provides access to a building with a step at the entrance, while minimizing the space required by the ramp.

SUMMARY

A first embodiment of a disclosed operable ramp is moveable between a stowed position and a deployed position. The operable ramp includes a ramp panel rotatable about a first end. A second end of the ramp panel is lower in the deployed position than in the stowed position. A rotatable support supports a second end of the ramp panel, and a drive assembly selectively rotates the support (1) in a first direction to lower the second end of the ramp panel and (2) in a second direction raise the second end of the ramp panel. A stop limits rotation of the support in the second direction when the operable ramp is in the stowed position. The weight of the ramp panel biases the support in the second direction, i.e., toward the stop, when the operable ramp is in the stowed position.

A second disclosed embodiment of an operable ramp is moveable between a stowed position, a neutral position, and a deployed position. The operable ramp includes a ramp panel rotatably coupled at a first end about a first axis. The operable ramp further includes a support that is rotatable in a first direction and a second direction about a second axis. A cam follower is coupled to the support and supportingly engages a second end of the ramp panel. Rotation of the support moves the cam follower along an arcuate path. The weight of the ramp panel does not bias the support to rotate when the operable ramp is in the neutral position; however, the weight of the ramp biases the support in the second direction when the operable ramp is between the stowed position and the neutral position. A drive assembly selectively rotates the support in the first and second direction, and a stop limits rotation of the support in the second direction when the operable ramp is in the stowed position.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Exemplary embodiments of the presently disclosed operable step will now be described with reference to the accompanying drawings, where like numerals correspond to like elements. Exemplary embodiments of the disclosed subject matter are directed to operable ramps, and more specifically, to operable ramps that are selectively moveable between a stowed "step" position and a deployed "ramp" position. In particular, several embodiments of the present invention are directed to operable ramps for use in architectural settings such as building entrances in which the indoor and outdoor levels differ, for example, when the building entrance includes a step.

The following discussion proceeds with reference to examples of operable ramps suitable for use at building entrances wherein there is a change in elevation, i.e., a step up or step down. While the examples provided herein have been described with reference to their association with building entrances, it will be apparent to one skilled in the art that this is done for illustrative purposes and should not be construed as limiting the scope of the disclosed subject matter, as claimed. Thus, it will be apparent to one skilled in the art that aspects of the disclosed operable ramp may be employed in a number of architectural settings, wherein a change in elevation, such as a step, provides an obstruction to a person with limited mobility.

The following detailed description may use illustrative terms such as higher, lower, inner, outer, vertical, horizontal, front, rear, proximal, distal, etc.; however, these terms are descriptive in nature and should not be construed as limiting. Further, it will be appreciated that embodiments of the disclosed subject matter may employ any combination of features.

Figure 1:
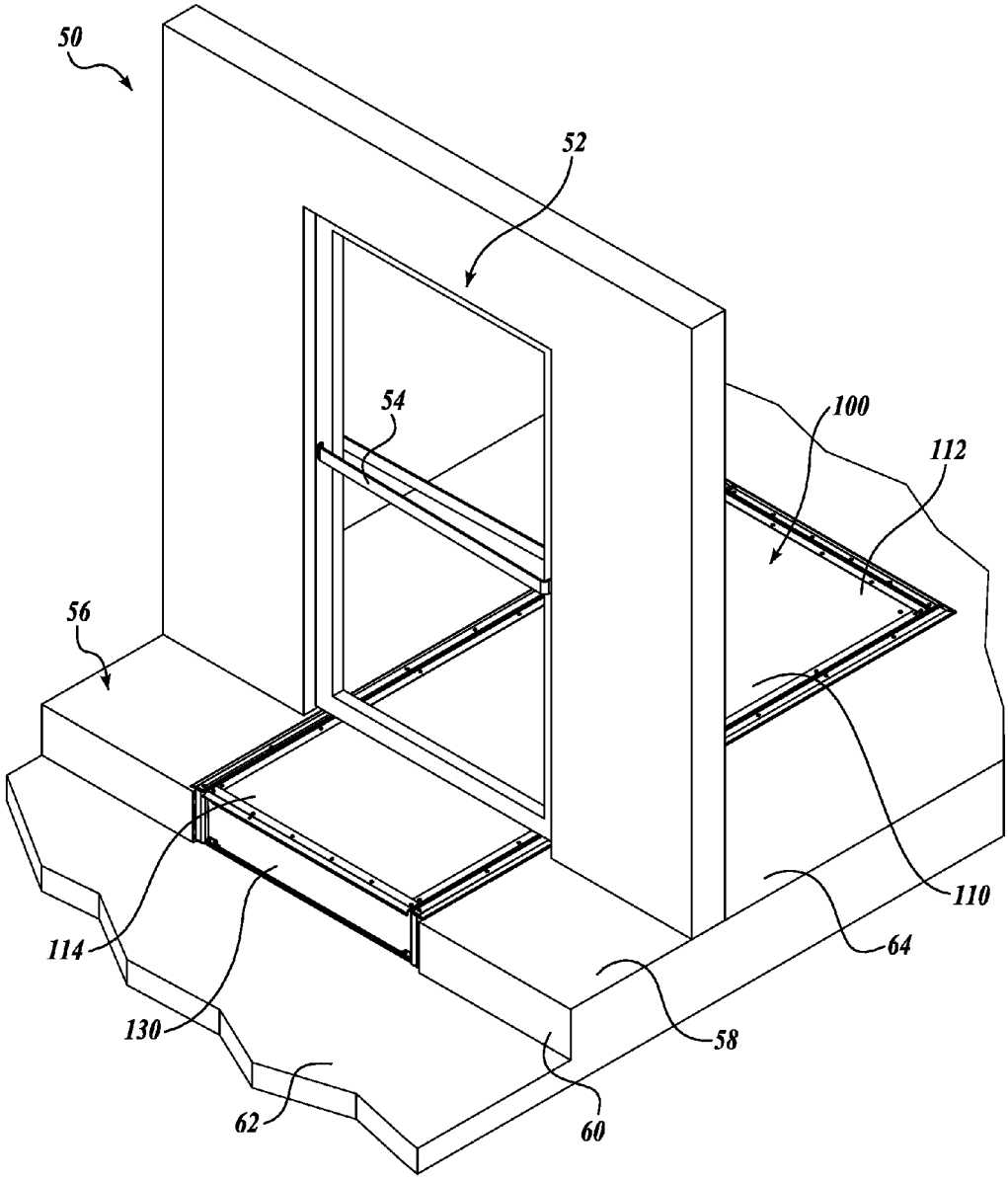
FIG. 1 shows an isometric view of an exemplary embodiment of an operable ramp installed in a doorway of an architectural setting with the operable ramp in a stowed position and the door closed.
Figure 2:
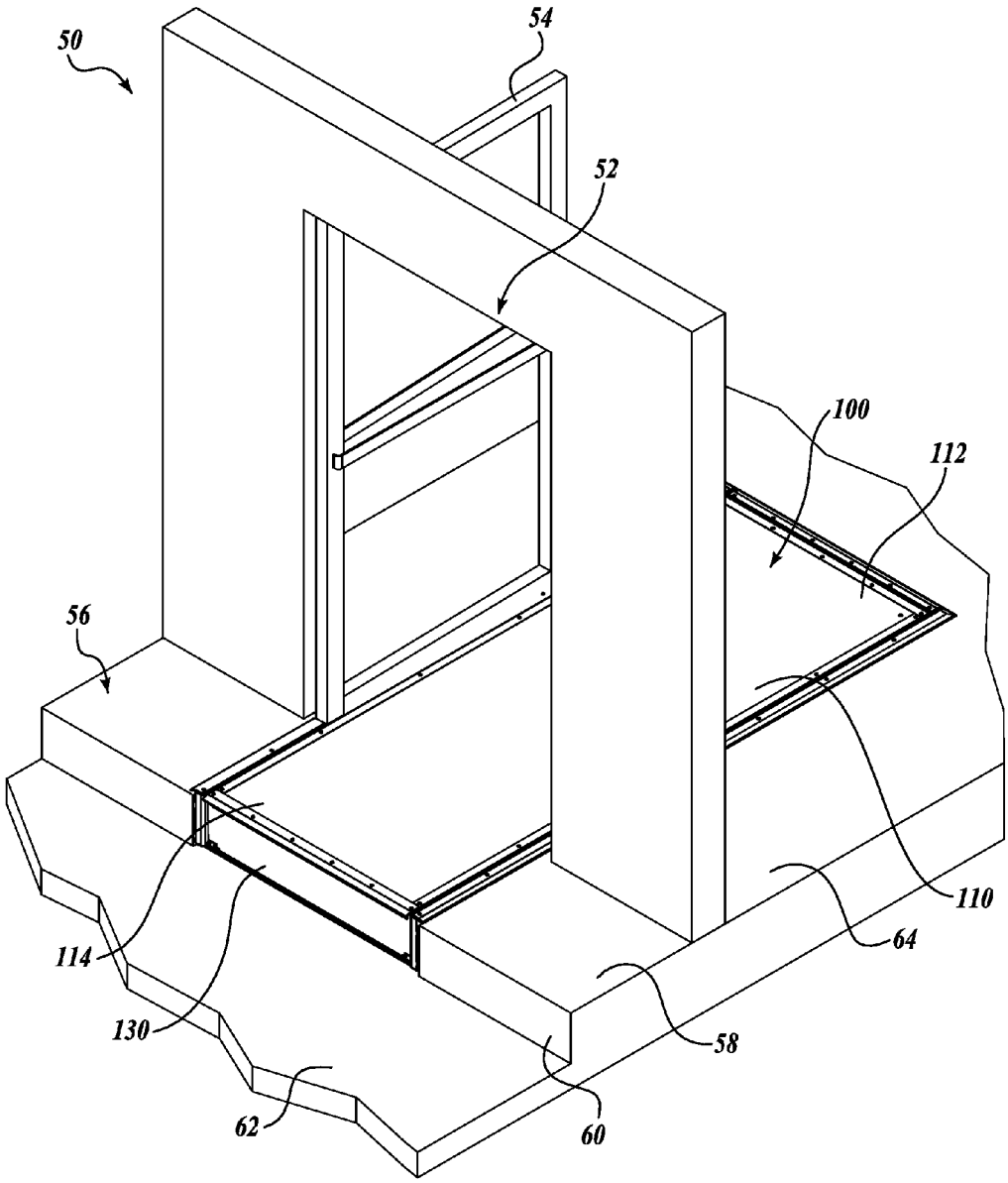
FIG. 2 shows an isometric view of the operable ramp of FIG. 1 with the door open.
Figure 3:
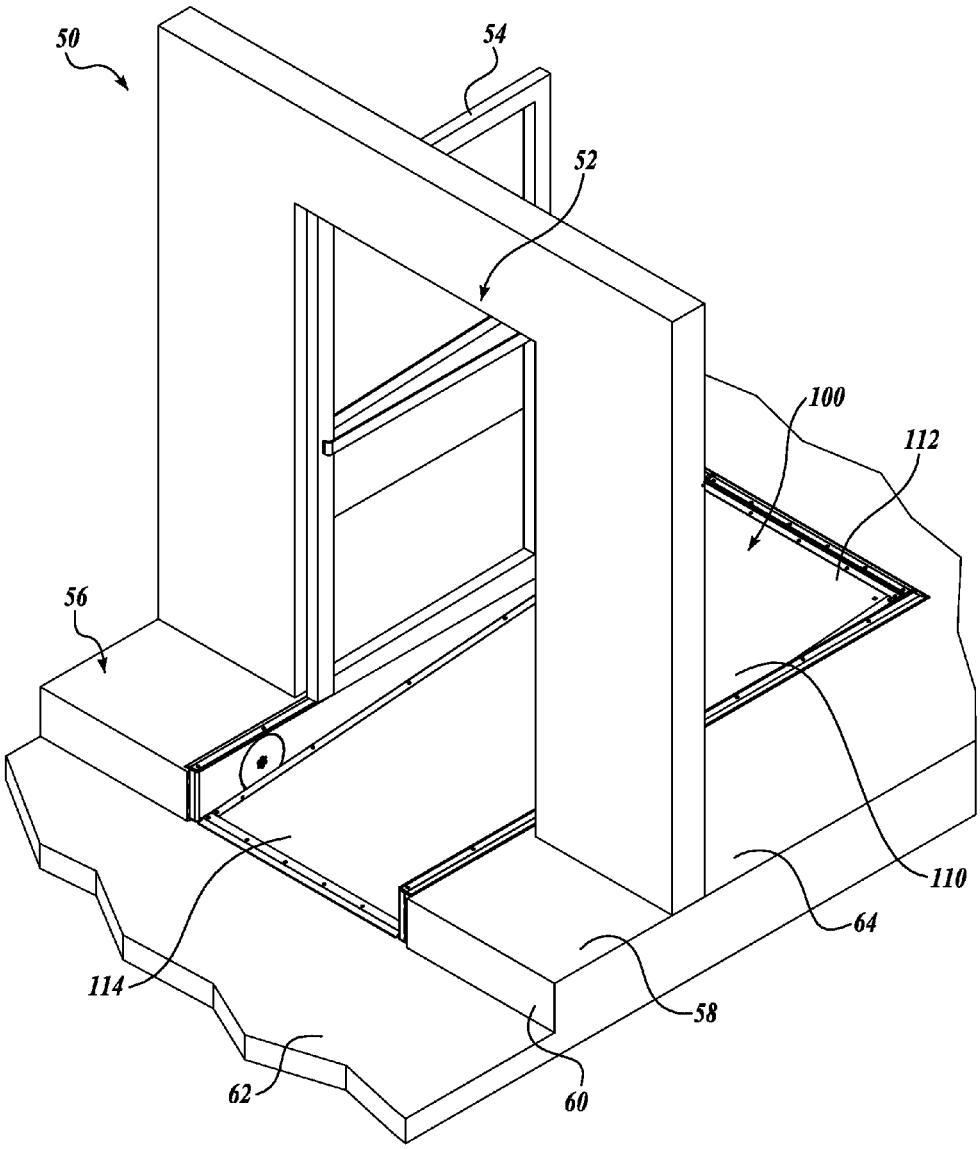
FIG. 3 shows an isometric view of the operable ramp of FIG. 1 in a deployed position.
Figure 4:
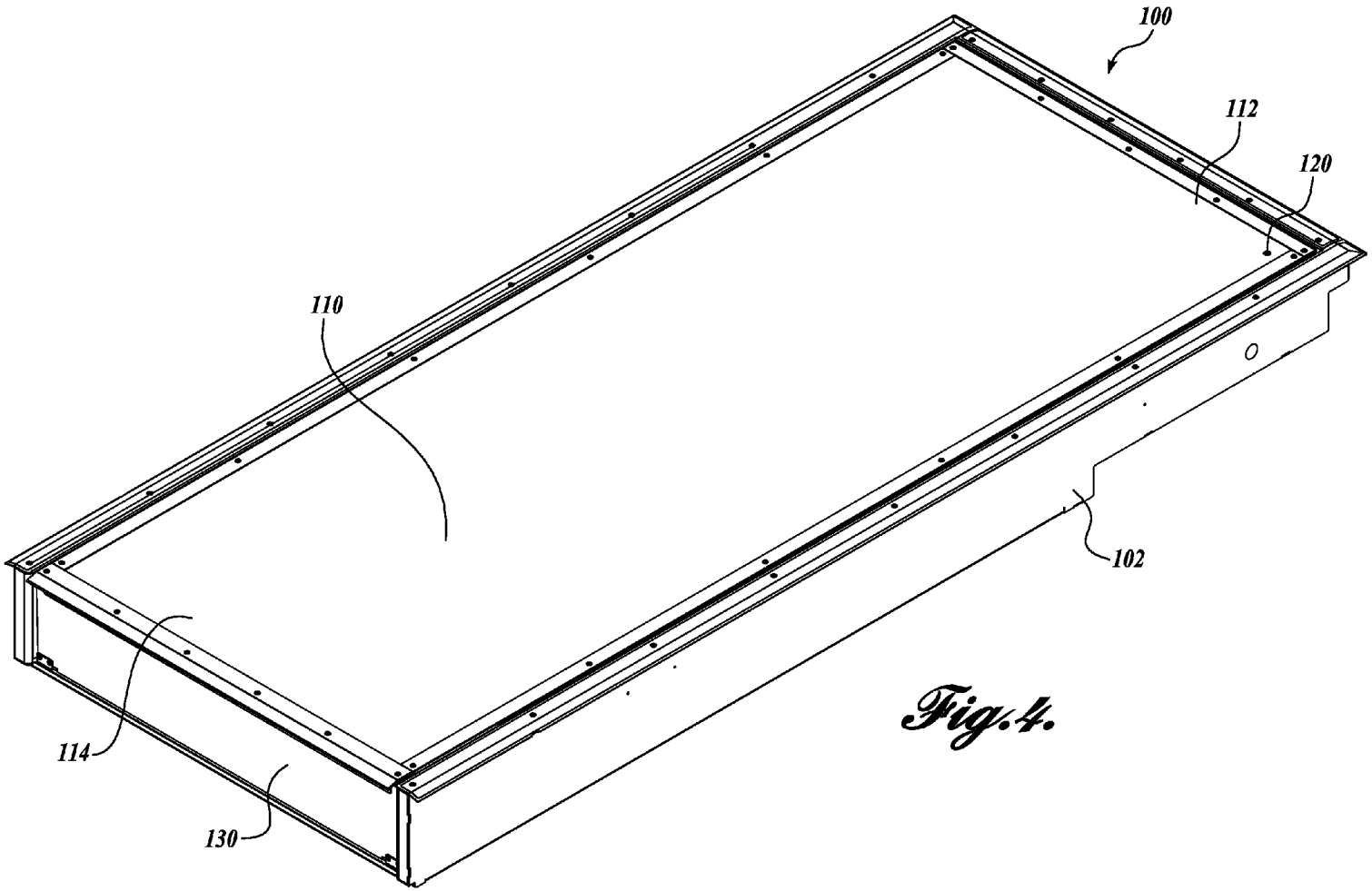
FIG. 4 shows an isometric view of the operable ramp of FIG. 1 in the stowed position.
Figure 5:
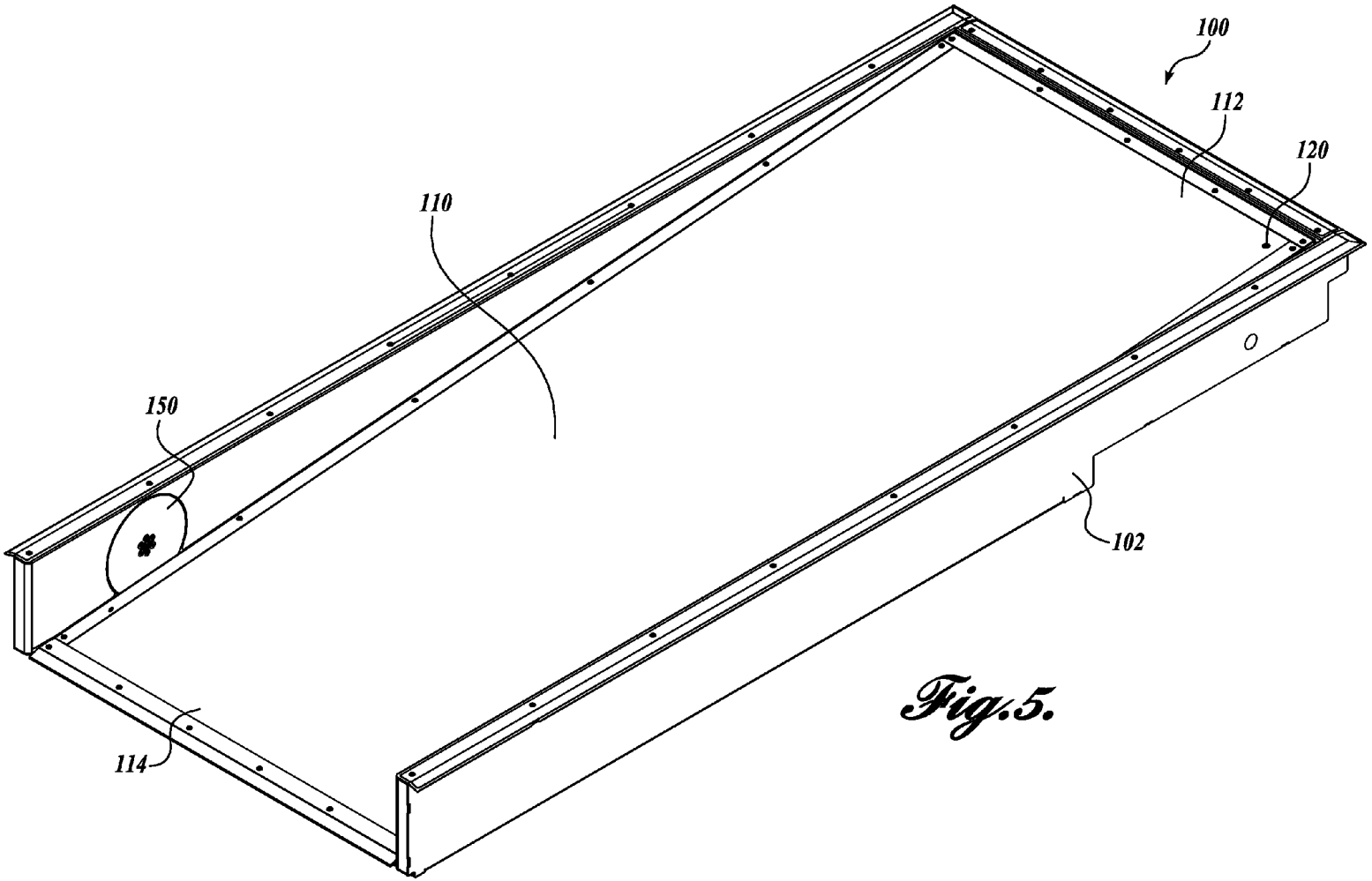
FIG. 5 shows an isometric view of the operable ramp of FIG. 4 in the deployed position.

FIGS. 1-5 show an exemplary embodiment of an operable ramp 100. More specifically, FIGS. 1-3 show the operable ramp 100 shown installed at the entrance 52 of a building 50, and FIGS. 4 and 5 show the same embodiment in isolation, i.e., not installed. Referring to FIGS. 1-3, an exemplary entrance 52 includes a door 54 with a step 56 positioned outside of the door. The step 56 includes a tread portion 58 and a riser portion 60. The tread portion 58 of the step 56 is level with the floor of the building 50 so that a person walking into the building uses the step to step up from a lower first surface 62 outside the building to a higher second surface 64 inside the building. It will be appreciated that the illustrated installation of the operable ramp 100 is exemplary only and should not be considered limiting. In this regard, the operable ramp 100 can be installed in any number of architectural settings having a step that would present an obstacle for a physically challenged person.

The operable ramp 100 includes a ramp panel 110 that provides a transition between the first surface 62 and the second surface 64. FIGS. 1 and 4 show the operable ramp 100 in a stowed position. In the stowed position, the operable ramp 100 forms a step such that the ramp panel 110 is generally horizontal and flush with the second surface 64. Thus, the ramp panel 110 acts as a tread that transitions into the second surface 64. The operable ramp 100 also has a closeout assembly 130 that forms a riser when the operable ramp is in the stowed position.

During deployment, the operable ramp 100 moves from the stowed position of FIGS. 1 and 4 to the deployed position of FIGS. 3 and 5. As the ramp is deployed, the ramp panel 110 rotates about its inner end 112 as the outer end 114 moves from a raised position to a lowered position. In the deployed position of FIGS. 3 and 5, the ramp panel 110 slopes downward from its inner end 112 to provide a transition surface that extends from the lower first surface 62 to the higher second surface 64.

The operable ramp 100 includes a frame 102. The frame provides a structure with a fixed position to which the components of the operable ramp 100 are attached. To install the operable ramp 100 in an architectural setting, the frame 102 is attached to surrounding structure to secure the operable ramp in place. Although the illustrated embodiments of the operable ramp 100 include a frame 102, other embodiments are contemplated in which the operable ramp 100 does not include a frame. To install such embodiments in architectural settings, the operable ramp 100 components are attached directly to the surrounding structure or to suitable structure within the building, thus making a frame 102 unnecessary. Accordingly, embodiments of the described operable ramp 100 that do not include a frame 102 should be considered within the scope of the present disclosure.

Referring to FIGS. 4-11, the ramp panel 110 is constructed from well-known materials to have suitable strength and durability. The ramp panel 110 is a generally flat rectangular panel rotatably associated at its inner end 112 to the frame 102 about a horizontal fixed axis 260. The ramp panel 110 is selectively rotatable about the axis 260 to reciprocate between a raised position when the operable ramp 100 is in the stowed position and a lowered position when the operable ramp is in the deployed position. A bearing surface 122 is disposed on a lower surface of the ramp panel 110 near the outer end 114 of the ramp panel. A surface extending downward from the outer end of the bearing surface 122 forms bearing stop 124.

Figure 6:
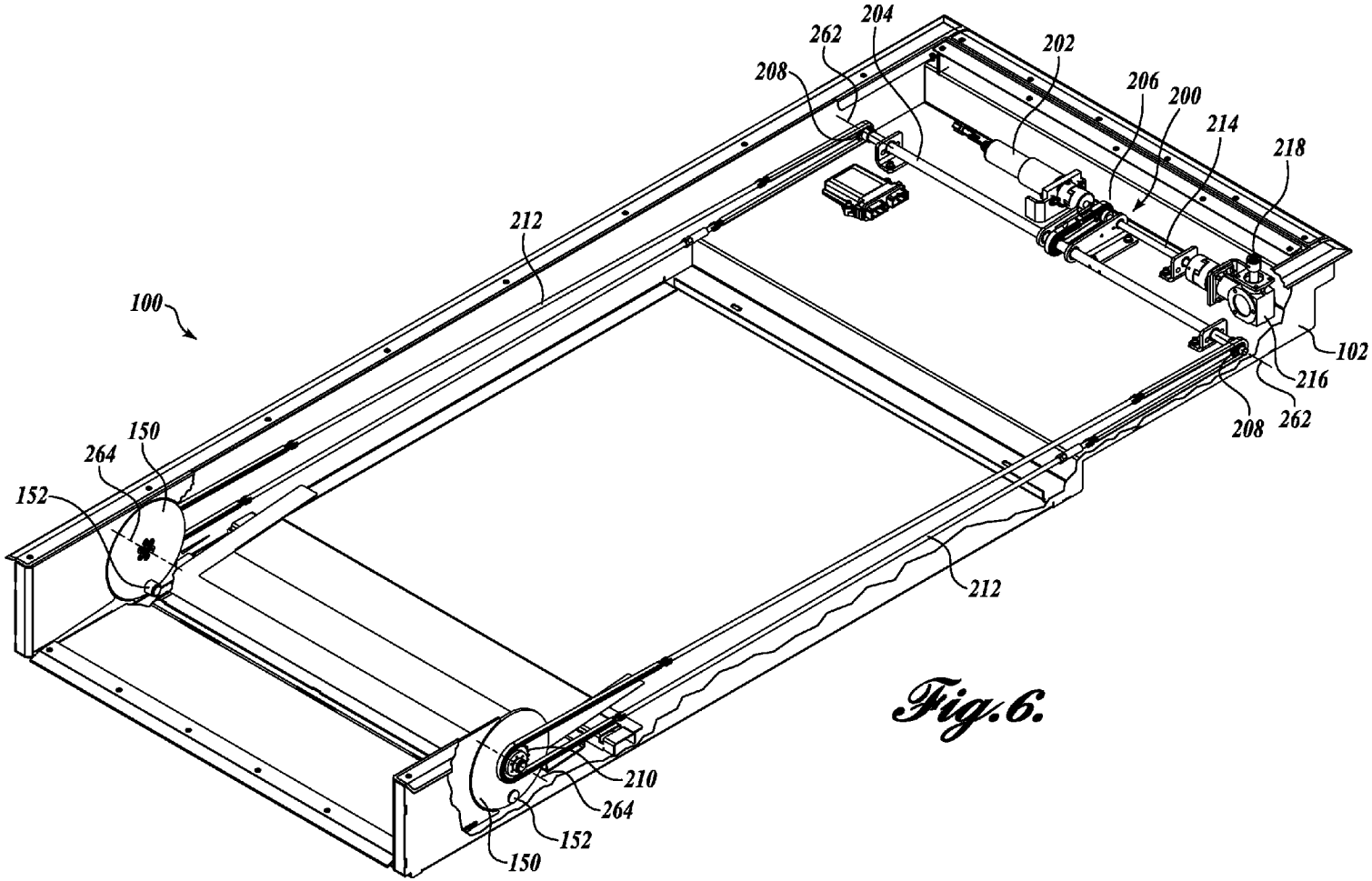
FIG. 6 shows a partially cutaway isometric view of the operable ramp of FIG. 4 in the deployed position.

As best shown in FIG. 6, a pair of supports 150 is rotatably mounted to the frame 102 such that the supports are located on opposite sides of the ramp panel 110 and are rotatable about a common axis 264. A cam follower 152 extends underneath the ramp panel 110 from each support 150 to supportingly engage the bearing surface 122. Each cam follower 152 has a centerline 270 that is offset from and parallel to axis 264 so that rotation of each support about axis 264 moves the corresponding cam follower 152 along an arcuate path.

Still referring to FIG. 6, the operable ramp 100 includes a drive assembly 200 to selectively reciprocate the operable ramp between the stowed position and the deployed position. In the disclosed embodiment, the drive assembly 200 includes a motor 202 disposed below the ramp panel 110. The motor 202 is operably coupled to a drive shaft 204 by a known transmission 206 so that the motor selectively rotates the drive shaft about a fixed axis 262. The drive shaft 204 extends across the width of the operable ramp 100 and has a drive sprocket 208 coupled to each end. Each drive sprocket 208 is operably coupled to one of the supports 150 so that the motor 202 selectively rotates both supports about axis 264. For the sake of clarity, the connection of one drive sprocket 208 to the corresponding support 150 is described with the understanding that the other drive sprocket 208 is coupled to its corresponding support in a similar manner.

The drive sprocket 208 is operably coupled to an outer sprocket 210 by a chain assembly 212 that forms an endless loop. The outer sprocket 210 is rotatably mounted to the frame 102 about axis 264 and is also coupled to the support 150 so that the support and the outer sprocket rotate together as a unit about axis 264, i.e., rotation of the outer sprocket 210 rotates the support 150.

To move the operable ramp 100 from the stowed position to the deployed position, the motor 202 rotates the drive sprockets 208 in a first direction, which in turn drives the chain assemblies 212 to rotate the outer sprockets 210, thereby rotating the supports 150 in the first direction about axis 264. To move the operable ramp 100 from the deployed position to the stowed position, the motor 202 rotates the drive sprockets in a second direction opposite the first direction, which rotates the supports 150 in the second direction about axis 264.

It will be appreciated that a number of alternate drive assemblies 200 can be utilized to selectively rotate the supports 150 in first and second directions about axis 264. In one alternate embodiment, two motors are utilized, each motor driving one of the supports 150 to reciprocate the operable ramp between the stowed position and the deployed position. In another alternate embodiment, instead of the disclosed motor with a rotary output, a linear actuator is operably coupled to the supports 150 through a linkage. In yet another possible embodiment, the drive assembly 200 includes a counterbalance to reduce the force required to actuate the operable ramp 100, thereby decreasing the size of the motor. These and other configurations that selectively rotate the supports 150 in first and second directions are contemplated and should be considered within the scope of the present disclosure.

Referring back to FIG. 6, a secondary shaft 214 is operably coupled at a first end to the drive sprocket 208 through the transmission 206 such that rotation of the secondary shaft in a first direction rotates the supports 150 about axis 264 in a first direction, and rotation of the secondary shaft in a second direction rotates the supports about axis 264 in a second direction. A second end of the secondary shaft 214 is coupled to the output of a gearbox 216. The gearbox includes an upward facing input shaft having a keyway 218, which is accessible from above the ramp panel 110 through an access hole 120 formed in the ramp panel, as shown in FIGS. 4 and 5.

In the event of a loss of power or a motor failure, an operator can actuate the operable ramp 100 manually. To do so, the operator inserts a crank through the access hole 120 into the keyway 218 and rotates the crank in a first direction to move the operable ramp 100 toward the deployed position, and in a second direction to move the operable ramp toward the stowed position. It will be appreciated that a number of variations to the illustrated manual deploy mechanism can be incorporated. In this respect, the size, position, and configurations of mechanisms that transfer a manual input into rotation of the supports can vary, and such variations should be considered within the scope of the present disclosure.

Figure 8:
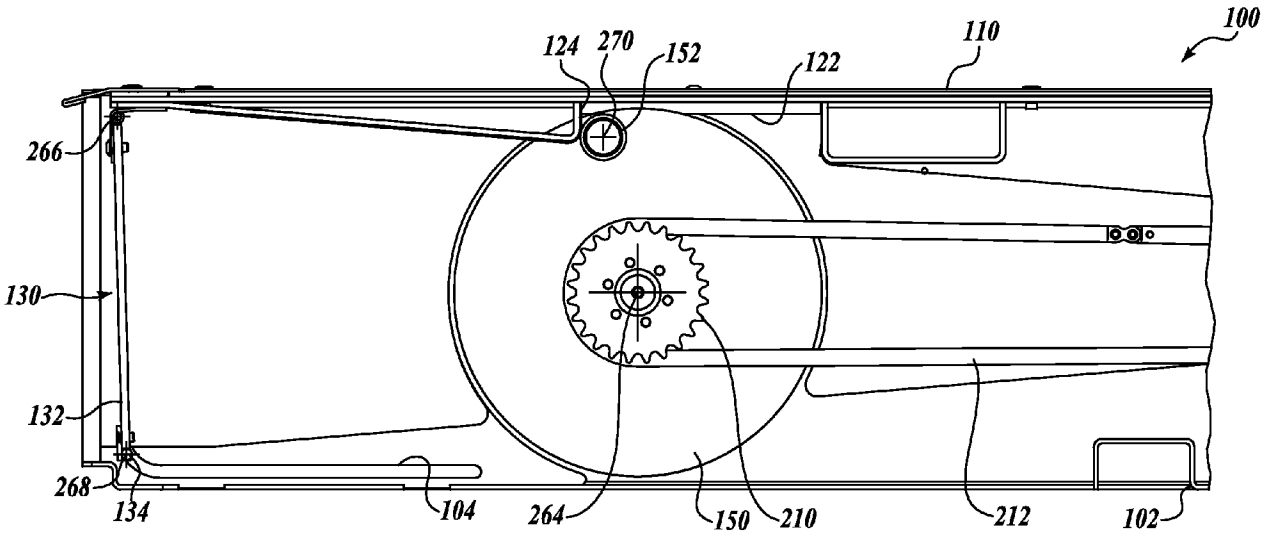
FIG. 8 shows a partial cutaway side view of the operable ramp of FIG. 7.
Figure 9:
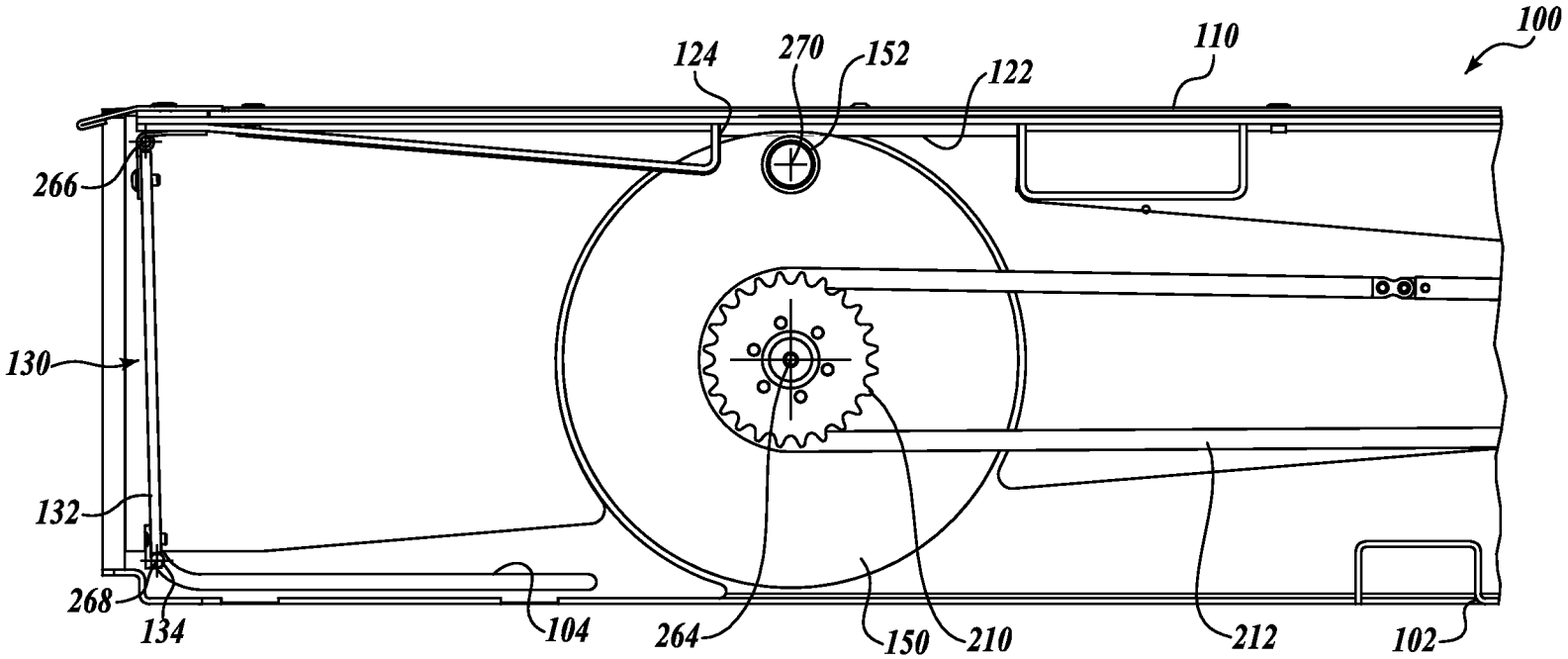
FIG. 9 shows a partial cutaway side view of the operable ramp of FIG. 1 in a neutral position.
Figure 10:
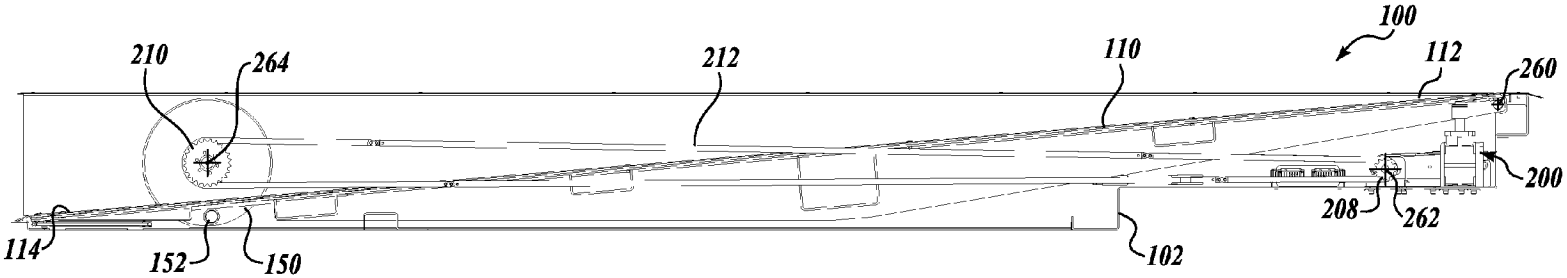
FIG. 10 shows a cutaway side view of the operable ramp of FIG. 1 in the deployed position.
Figure 11:
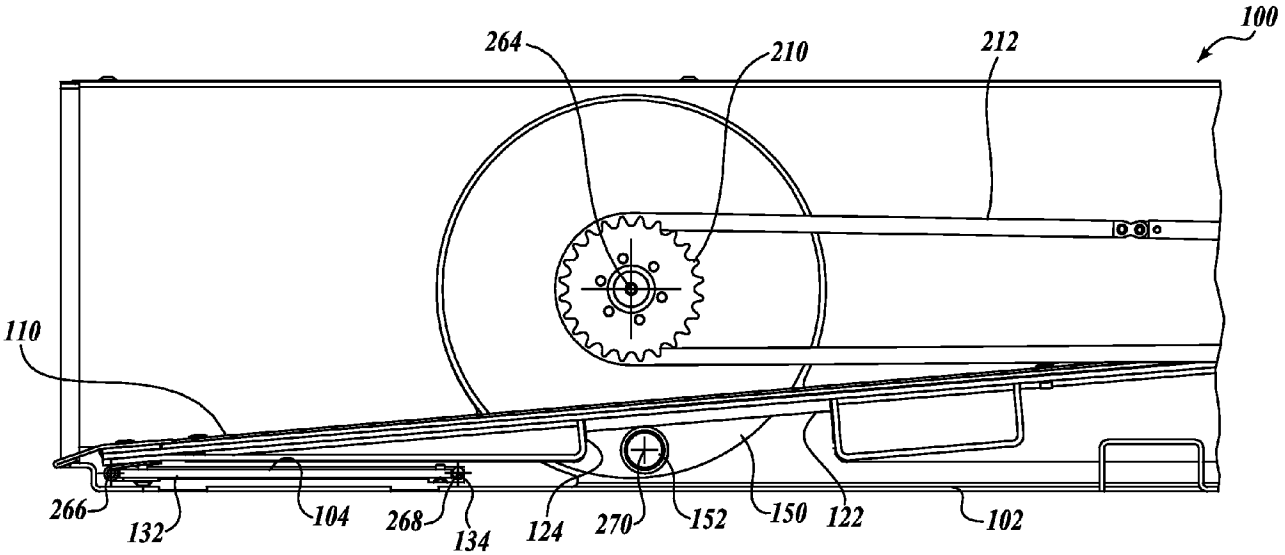
FIG. 11 shows a partial cutaway side view of the operable ramp of FIG. 10.

Referring to FIGS. 8 and 11, the operable ramp 100 includes a closeout assembly 130 that acts as a riser when the operable ramp is in the stowed position (FIG. 8) and folds under the ramp panel 110 as the operable ramp moves to the deployed position (FIG. 11). The closeout assembly 130 includes a flat panel 132 rotatably coupled at a first end to the ramp panel 110 about an axis 266. A cam follower 134 is coupled to a second end of the flat panel 132 about axis 268 such that axis 268 is parallel to axis 266. The cam follower 134 engages a slot 104 formed in frame 102. In the stowed position, axis 266 and the engagement of the cam follower 134 with the slot 104 positions the panel 132 in a vertical orientation that extends from the upper surface of the operable ramp 100 to the lower first surface 62, thereby forming a riser to the step formed by the operable ramp.

Figure 7:
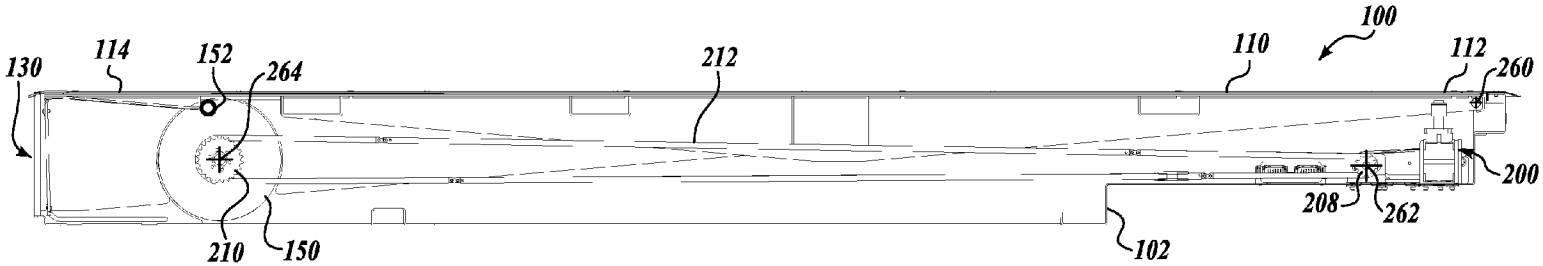
FIG. 7 shows a cutaway side view of the operable ramp of FIG. 1 in the stowed position.

Referring now to FIGS. 7-11, deployment of the operable ramp 100 will be described. FIGS. 7 and 8 show the operable ramp 100 in the stowed position. When so positioned, the ramp panel 110 is rotatably supported at the inner end 112 by the frame 102. The outer end 114 of the ramp panel 110 is supported by the engagement of the cam followers 152 with the bearing surface 122 located on the lower side of the ramp panel 110. Thus, the frame 102 and the cam followers 152 support the ramp panel 110 in a generally horizontal position.

As best shown in FIG. 8, when the operable ramp 100 is in the stowed position, the centerline 270 of the cam followers 152 is located to the outward side of the axis 264 of rotation of the supports 150, i.e., to the left as shown in FIG. 8. As a result, the ramp panel 110 applies a downward force on the cam followers 152 that tends to rotate the supports 150 in the counterclockwise direction as viewed in FIG. 8. At the same time, the cam followers 152 are engaged with the bearing stops 124, which prevents rotation of the supports 150 in the counterclockwise direction. In the event of a power disruption or drive assembly 200 failure, the bearing stops 124 maintain the position of the cam followers 152 and, therefore, the ramp panel 110.

To deploy the operable ramp, the drive assembly rotates the supports 150 in a clockwise direction, as viewed in FIG. 8. The rotation of the supports 150 move the cam followers along an arcuate path until the operable ramp 100 reaches the neutral position shown in FIG. 9. When the operable ramp 100 is in the neutral position, the centerline 270 of the cam followers 152 is positioned directly above the axis 264 of rotation of the supports 150. As a result, the weight of the ramp panel 110 does not tend to rotate the supports in either direction.

The supports 150 continue to rotate in the clockwise direction (as viewed in FIGS. 7-11) from the neutral position, which continues to move the cam followers 152 along an arcuate path. This movement lowers the height of the cam followers 152 and, therefore, the outer end 114 of the ramp panel 110, which is supported by the cam followers. Rotation of the supports 150 continues until the operable ramp 100 reaches the deployed position of FIGS. 10 and 11. In the illustrated embodiment, the cam followers 152 maintain contact with the bearing surface 122 when the operable ramp 100 is in the deployed position, however alternate embodiments are contemplated wherein the cam followers 152 disengage from the bearing surface during deployment, and the outer end 114 of the ramp panel 110 is supported by the frame 102, the lower first surface 62 or other suitable structure.

Movement of the ramp panel 110 during deployment folds the closeout assembly 130 under the ramp panel. As the operable ramp 100 moves from the stowed position to the deployed position, axis 266 moves in a downward direction with the ramp panel 110. The position of the second end of the flat panel 132 is controlled by the cam follower 134, which moves along the slot 104 in an inward direction. As a result, the closeout assembly 130, which acts as a riser in the stowed position, folds underneath the ramp panel 110, out of the way of the transition surface provided by the deployed operable ramp 100.

To move the operable ramp 100 from the deployed position to the stowed position, the drive assembly 200 rotates the supports 150 in a counterclockwise direction, as viewed in FIGS. 7-11. Rotation of the supports 150 raises the cam followers 152 along an arcuate path, thereby raising the outer end 114 of the ramp panel 110. The rotation of the supports 150 continues through the neutral position of FIG. 9 until the operable ramp 100 reaches the stowed position of FIGS. 7 and 8. Although the illustrated embodiment shows the cam followers 150 in contact with the bearing stop 124 when the operable ramp 100 is in the stowed position, it will be appreciated that some embodiments are possible in which the drive assembly 200 alone maintains the position of the support 150 and, therefore, the ramp panel 110 in the stowed position. For such embodiments, the cam followers 152 need not be in contact with the bearing stop 124 when the operable ramp 100 is in the stowed position. For such configurations, the cam followers 152 only contact the bearing stop 124 in the event of a power disruption or drive assembly 200 failure after the ramp panel 110 begins to move.

As the operable ramp 100 moves from the deployed position to the stowed position, axis 266 and, therefore, the first end of the flat panel 132, move in an upward direction with the ramp panel 110. The second end of the flat panel 132 moves outwardly along the slot 104 until the panel 132 returns to a generally vertical orientation, at which point the closeout assembly 130 functions as a riser for the operable step 100.

While illustrative embodiments have been illustrated and described, it will be appreciated that various changes can be made therein without departing from the spirit and scope of the invention.

The embodiments of the invention in which an exclusive property or privilege is claimed are defined as follows:

1. An operable ramp moveable between a stowed position and a deployed position, the operable ramp comprising:

(a) a ramp panel rotatably coupled at a first end about a first axis, a second end of the ramp panel being lower in the deployed position than in the stowed position;

(b) a support rotatable about a second axis, the support supporting the second end of the ramp panel;

(c) a drive assembly operably coupled to the support to selectively rotate the support (1) in a first direction to lower the second end of the ramp panel and (2) in a second direction raise the second end of the ramp panel; and (d) a stop limiting rotation of the support in the second direction when the operable ramp is in the stowed position, wherein a weight of the ramp panel biases the support to rotate in the second direction when the operable ramp is in the stowed position.

2. The operable ramp of claim 1, further comprising a cam follower coupled to the support, the cam follower engaging a bearing surface disposed on the ramp panel.

3. The operable ramp of claim 2, wherein rotation of the support moves the cam follower along an arcuate path.

4. The operable ramp of claim 2, wherein the stop extends downward from the ramp panel.

5. The operable ramp of claim 2, wherein the stop engages the cam follower when the operable ramp is in the stowed position.

* * * * *

UNITED STATES PATENT AND TRADEMARK OFFICE

CERTIFICATE OF CORRECTION

PATENT NO. : 8,832,893 B1
APPLICATION NO. : 14/152929
DATED : September 16, 2014
INVENTOR(S) : D. Morris et al.

It is certified that error appears in the above-identified patent and that said Letters Patent is hereby corrected as shown below:

ON THE TITLE PAGE

| COLUMN | LINE | ERROR |
|---|---|---|
| (73) Pg. 1, col. 1 | Assignee | "**Lift-U, division of Hogan Mfg., Inc.,**" should read **--Lift-U, Division of Hogan Mfg., Inc.,--** |

Signed and Sealed this
Twenty-seventh Day of October, 2015

Michelle K. Lee

Michelle K. Lee
*Director of the United States Patent and Trademark Office*